US011545332B1

(12) United States Patent
Miller et al.

(10) Patent No.: US 11,545,332 B1
(45) Date of Patent: Jan. 3, 2023

(54) ANODE SHIELD

(71) Applicant: Varex Imaging Corporation, Salt Lake City, UT (US)

(72) Inventors: Robert S. Miller, Holladay, UT (US); Gregory C. Andrews, West Jordan, UT (US)

(73) Assignee: Varex Imaging Corporation, Salt Lake City, UT (US)

( * ) Notice: Subject to any disclaimer, the term of this patent is extended or adjusted under 35 U.S.C. 154(b) by 0 days.

(21) Appl. No.: 16/999,684

(22) Filed: Aug. 21, 2020

Related U.S. Application Data

(60) Provisional application No. 62/890,581, filed on Aug. 22, 2019.

(51) Int. Cl.
*H01J 35/08* (2006.01)

(52) U.S. Cl.
CPC ..... *H01J 35/112* (2019.05); *H01J 2235/081* (2013.01); *H01J 2235/083* (2013.01); *H01J 2235/084* (2013.01); *H01J 2235/086* (2013.01)

(58) Field of Classification Search
CPC ..... H01J 35/112; H01J 2235/083; H01J 2235/084; H01J 2235/086
See application file for complete search history.

(56) References Cited

U.S. PATENT DOCUMENTS 3,819,971 A * 6/1974 Kaplan ..... H01J 35/108 378/144
4,870,671 A * 9/1989 Hershyn ..... H01J 35/112 378/124
6,393,099 B1 5/2002 Miller
6,690,765 B1 * 2/2004 Miller ..... H01J 35/112 378/124
9,941,092 B2 4/2018 Greenland et al.
2016/0163497 A1 * 6/2016 Greenland ..... H01J 35/18 378/140

FOREIGN PATENT DOCUMENTS

JP 2001-148226 5/2001
JP 2005-190877 7/2005
JP 2016-111019 6/2016

OTHER PUBLICATIONS

Japanese Patent Application No. 2020-141130, Notice of Reasons for Rejection, dated Aug. 3, 2021.
Japanese Patent Application No. 2020-141130, Notice of Reasons for Rejection (translation), dated Aug. 3, 2021.
(Continued)

*Primary Examiner* — Chih-Cheng Kao
(74) *Attorney, Agent, or Firm* — Laurence & Phillips IP Law

(57) ABSTRACT

Technology is described for an anode including a substrate, a target, and an anode shield. The substrate including a substrate material includes a first portion with a first cross-sectional dimension, and a second portion with a second cross-sectional dimension greater than the first cross-sectional dimension. The target includes a target material attached to a first surface of the first portion of the substrate. The anode shield includes a shield material attached to a second surface of the second portion of the substrate, and the substrate material differs from the target material and the shield material.

20 Claims, 8 Drawing Sheets

(56) References Cited

OTHER PUBLICATIONS

Japanese Patent Application No. 2020-141130, Search Report, dated Jun. 23, 2021.
Japanese Patent Application No. 2020-141130, Search Report (translation), dated Jun. 23 2021.
Japanese Patent Application No. 2020-141130, Written Opinion, dated Jan. 4, 2022.
Japanese Patent Application No. 2020-141130, Written Opinion (translation), dated Jan. 4, 2022.
Japanese Patent Application No. 2020-141130, Written Amendment dated Jan. 4, 2022.
Japanese Patent Application No. 2020-141130, Written Amendment (translation), dated Jan. 4, 2022.
Japanese Patent Application No. 2020-141130, Decision to Grant, dated Apr. 5, 2022.
Japanese Patent Application No. 2020-141130, Decision to Grant (translation), dated Apr. 5, 2022.

* cited by examiner

ANODE SHIELD

BACKGROUND

X-ray assemblies and systems may generally include a cathode that directs a stream of electrons into a vacuum, and an anode that receives the electrons. When the electrons collide with a target on the anode, some of the energy may be emitted as x-rays, and some of energy may be released as heat. The emitted x-rays may be directed at samples to determine information about the samples. Unless otherwise indicated herein, the approaches described in this section are not prior art to the claims in this disclosure and are not admitted to being prior art by inclusion in this section.

DETAILED DESCRIPTION OF SOME EXAMPLE EMBODIMENTS

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Numbers provided in flow charts and processes are provided for clarity in illustrating steps and operations and do not necessarily indicate a particular order or sequence. Unless otherwise defined, the term "or" can refer to a choice of alternatives (e.g., a disjunction operator, or an exclusive or) or a combination of the alternatives (e.g., a conjunction operator, and/or, a logical or, or a Boolean OR).

Disclosed embodiments relate generally to structures, methods, and systems to improve spectral purity of x-ray beams generated from an analytical x-ray tube by anode geometry and an anode shield. Disclosed embodiments also relate generally to an anode shield for a stationary x-ray tube.

Spectral purity of an analytical x-ray tube's x-ray beam can be compromised by some features of anode geometry.

Specifically, if features of the anode geometry are conical in shape or perpendicular to the exit window of the x-ray tube, a probability exists that backscatter electrons will produce characteristic x-ray from these surfaces. If the surfaces are not constructed of the same materials as the focal spot impingement area (or target area), the x-rays generated from these surfaces will not be the characteristic x-rays intended from the tube resulting in a spectral contamination. The disclosed anode shield provides a means whereby the unwanted spectral contamination is measurable reduced.

Conventionally in a stationary anode x-ray tube, the anode includes a target and an anode base or substrate to support the target and conduct heat away from the target that is generated from electrons striking the target. Due to the relatively high cost and/or lower thermal conductivity of the target material of the target to the substrate materials used in the anode base or substrate, the composition of the target material typically differs from the substrate materials. Although the area of the target does not have to be large to generate x-rays, the heat produced by the target when x-rays are being generated can be significant which can increase the temperature of the target, which can evaporate the target material, degrade the target or the x-ray tubes, and/or melt other features of the anode if the generated heat is not conduct the heat away from the target area. Typically, mechanisms are used to cool or reduce the temperature of the target and conduct the heat away from the target, such as using high thermal conductivity materials, increasing the cross-sectional area of the anode volume around the target, and/or using liquid cooling anode features around the target.

Figures 2A, 2B, 2C:
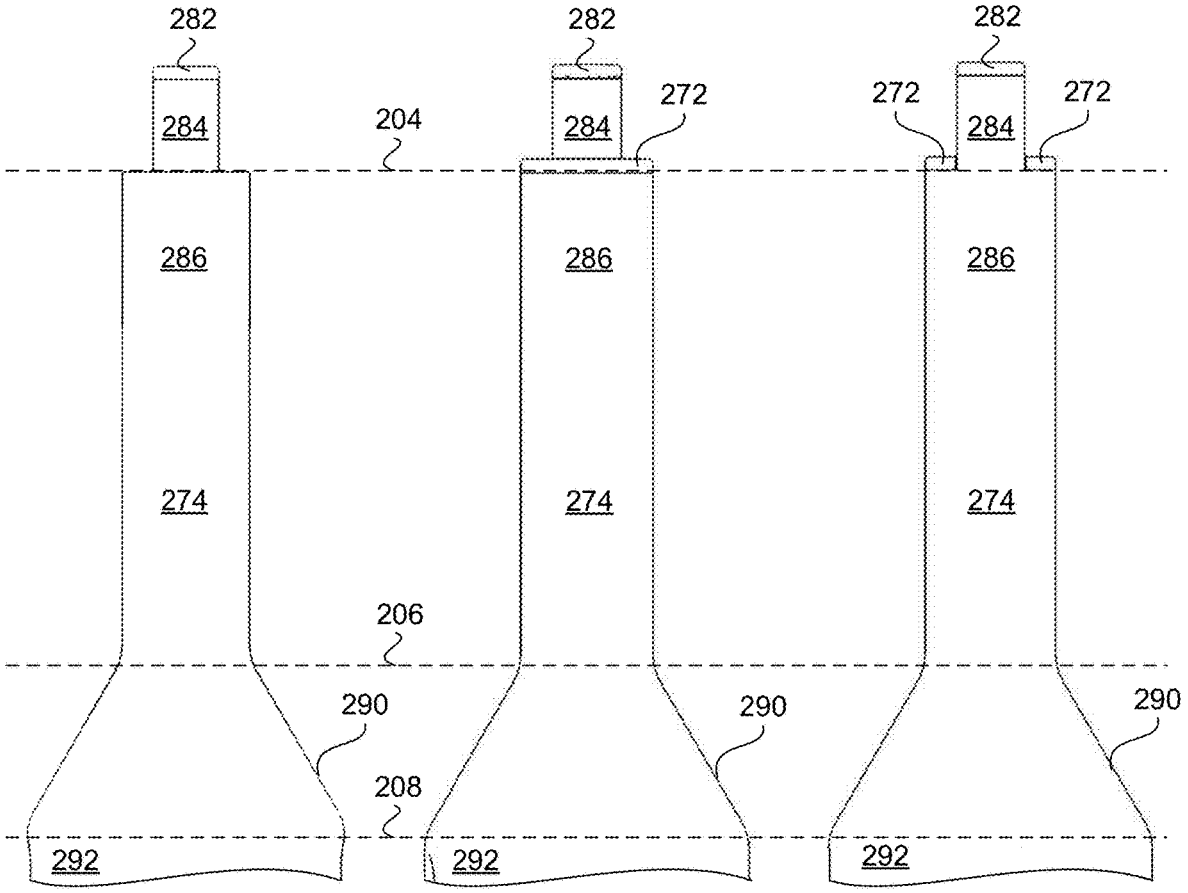
FIG. 2A illustrates a side view of an anode without an anode shield.
FIG. 2B illustrates a side view of an anode with an anode shield.
FIG. 2C illustrates a section view of an anode with an anode shield.

U.S. Pat. No. 9,941,092 ("'092 Patent"), entitled "X-ray Assemblies and Coating," granted on Apr. 10, 2018, which is incorporated by reference in its entirety, provides an example of a conventional anode with an increasing graduated cross-sectional area from the target 82 to the other end of the anode base or substrate 74 (as shown in FIGS. 2A and 3 of the '092 Patent). For example, a taper 88 is used between a first narrow portion 84 and a second wide portion 86 (as shown in FIGS. 2A and 3 of the '092 Patent).

As illustrated in the '092 Patent, only a portion of electrons emitted by an electron emitter that impact the target 82 may be absorbed by the target resulting in an emission of radiation (referred to as "primary x-rays"). The characteristics of the emitted radiation (e.g., wavelength, frequency and/or energy) may depend on the material of the target, the energy of the impacting electrons, the voltage of the x-ray tube, and/or other aspects. Some of the remaining electrons impacting the target may be backscattered instead of being absorbed by the target. Some of the x-rays generated by backscattered electrons (referred to as "backscattered x-rays") may also exit the x-ray transmissive window of the x-ray tube along with the primary x-rays. As the target material may be different from the substrate material, the primary x-rays may have different radiation characteristics from the backscattered x-rays, which can have an adverse effect on the image or the spectroscopy, referred to as spectral contamination, as described in more detail below.

A conventional approach to reduce spectral contamination from the substrate material of the anode base or substrate is to use a coating of a target material on surfaces near the target, such as the first portion 84 (not covered by the target 82) and taper 88, as illustrated in the '092 Patent. The coating can be applied by electroplating. Unfortunately, electroplating a target material may not produce a thick enough layer to block the x-rays generated by the substrate materials below the coating that can cause spectral contamination. For example, electroplating rhodium (Rh) may only produce a 1.5 micrometer (μm or micron) coating before the coating exhibits undesirable characteristics, such as flaking at operating temperatures of the x-ray tube. A thickness of 50 microns of rhodium may be needed to shield over 99.9% of radiation from backscatter x-rays generated from copper below the rhodium. Thermal spraying (e.g., plasma spraying), chemical vapor deposition (CVD), plasma-enhanced CVD (PECVD), physical vapor deposition (PVD), sputtering or sputter deposition, and high velocity oxygen fuel spraying (HVOF) may be used to produce thicker coatings than electroplating without undesirable characteristics, but the processing costs may be much higher than electroplating and thus increase the cost of manufacturing the anode.

In another example, conventional anodes may use an anode sleeve 30 or 30' to cover a portion of an anode substrate 17 of a stationary anode structure 16, as illustrated by U.S. Pat. No. 6,690,765 ("765 Patent"), entitled "Sleeve for a Stationary Anode in an X-ray Tube," granted on Feb. 10, 2004, which is incorporated by reference in its entirety. An anode sleeve may be more difficult and costlier to manufacture than using an anode shield as described below as the anode sleeve covers more surfaces.

Figure 1:
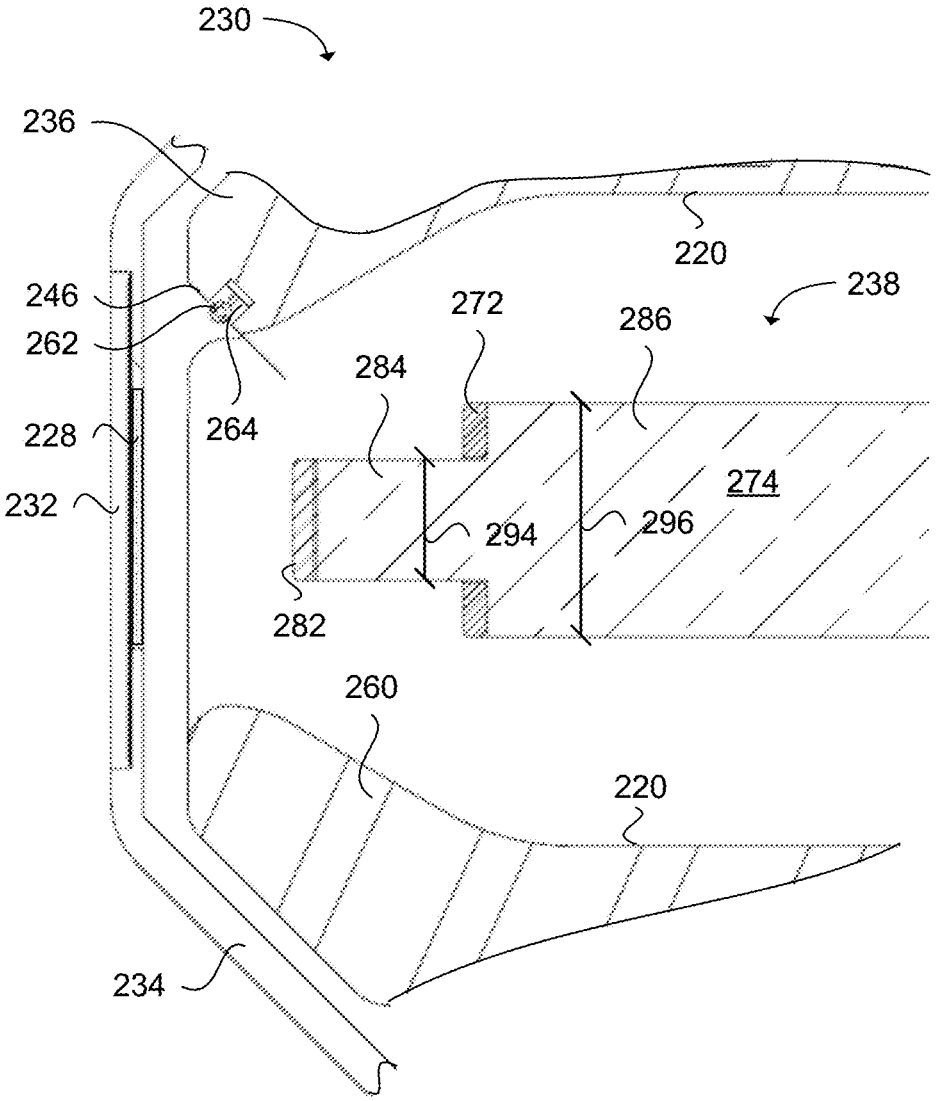
FIG. 1 illustrates a cross section view of an x-ray assembly.

FIG. 1 illustrates a cross section view of an x-ray tube 230 that includes a vacuum enclosure 234 including an x-ray transmissive window 232 covering an opening 228 in the vacuum enclosure 234, a cathode assembly 236 and an anode assembly 238 disposed within the vacuum enclosure 234.

The cathode assembly 236 can include an electron emission face 246 and an electron source, such as electron emitter 262 (e.g., cathode filament) and a focusing slot 264, configured to emit electrons, and focusing electrode 260. The focusing electrode 260 may be configured to focus electrons travelling from the electron emission face 246 to the target 282. The focusing electrode 260 can include a substantially geometrically continuous surface 220 (e.g., without corner or sharp edges) facing at least a first portion 284 and a second portion 286 of an anode substrate 274 of the anode assembly 238.

The anode assembly 238 or anode is configured to generated x-rays from electrons striking the target 282. The anode 238 can include a substrate 274 including a substrate material with a first portion 284 with a first cross-sectional dimension 294 and a second portion 286 with a second cross-sectional dimension 296 greater than the first cross-sectional dimension 294, and a target 282 including a target material attached to a first surface of the first portion 284 of the substrate 274, and an anode shield 272 including a shield material attached to a second surface of the second portion 286 of the substrate 274. The substrate material differs from the target material and the shield material.

FIGS. 2A-2C illustrate expanded views of the anode 238. The first portion 284, the second portion 286, and a third portion 292 of the substrate 274 can form elliptic cylinders (e.g., circular cylinders). The tapered portion 290 can form a conical frustum. Although the first portion 284, the second portion 286, the tapered portion 290, and the third portion 292 of the substrate 274 can be an integrated or continuous material, line 204 shows the virtual separation between the first portion 284 and the second portion 286, line 206 shows the virtual separation between the second portion 286 and the tapered portion 290, and line 208 shows the virtual separation between the tapered portion 290 and the third portion 292. Substantially parallel surfaces can be formed between the first portion 284 and the target 282 and between the first portion 284 and the second portion 286. "Substantially" in context of angles refers to within 1° . For example, substantially parallel refers to surfaces or planes that are less than 1° of each other. Substantially perpendicular or substantially orthogonal refers to surfaces or planes that are between 89° and 91° of each other.

The target is formed of materials that generate significant x-rays when high energy electrons strike the target materials. Similarly, the shield materials used in the anode shield 272 may use materials similar to the target materials. For example, target material and shield materials can include scandium (Sc), titanium (Ti), cobalt (Co), molybdenum (Mo), rhodium (Rh), palladium (Pd), tungsten (W), platinum (Pt), niobium carbide (NbC or $Nb_2C$), tantalum carbide ($TaC_x$), or combinations thereof. In an example, the target material and the shield material comprise substantially the same material. As a result, the anode shield 272 using similar materials as the target 282, the anode shield 272 may also be referred to as a stepped target or a target shield and the anode 238 may be referred to as a shielded anode. Substantially the same material can refer to a material that has 90%, 95%, or 99% the same chemical composition as another material.

Material properties of a good substrate material for x-ray tube and vacuum environments include a high melting point for use in high temperature environments, high thermal conductivity to conduct heat away from the target, and low material cost to improve profitability in manufacture. The melting point is the temperature at which a material changes state from solid to liquid. Thermal conductivity is a measure of a material's ability to conduct heat. Suitable substrate materials with the properties listed include copper (Cu), silver (Ag), pyrolytic carbon or pyrolytic graphite (C), or combinations thereof. Copper has a melting point of 1084.62° Celsius (C) or 1357.77 Kelvin (K) and a thermal conductivity of 401 watts per meter-kelvin (W/(m·K)). Silver (Ag) has a melting point of 961.78° C. or 1244.93 Kelvin (K) and a thermal conductivity of 429 W/(m·K). Pyrolytic carbon or pyrolytic graphite (C) has thermal conductivity at 700° C. of 1.2-4.6 W/(m·K) perpendicular to the deposition plane and 150-310 W/(m·K) parallel to the deposition plane. Pyrolytic carbon (or pyrolytic graphite) is a material similar to graphite, but with some covalent bonding between its graphene sheets, which more thermally conductive along the cleavage plane than graphite, making a good planar thermal conductor.

In an example, the substrate material has a melting point greater than 900° C. In an example, the substrate material has a thermal conductivity greater than 300 W/(m·K).

The target 282 may be coupled to the first portion 284 of the substrate 274 by brazing. Brazing the target 282 may be advantageous because brazing may facilitate tighter control of tolerances, facilitate uniform heating of the materials, decrease thermal distortion of the joined materials, and/or facilitate producing clean joints. Similarly, the anode shield 272 may be coupled to a planar surface 226 (FIGS. 3A-3B) of the second portion 286 of the substrate 274 by brazing, or the anode shield may be coupled to tapered surfaces (not shown) between the first portion 284 and the second portion 286 of the substrate by brazing. The anode shield can cover any planar surface substantially perpendicular to side walls of the first portion 284 (or second portion 286) or conical portions of anode structure near the target (used to generate the focal spot) with the same material as the target. The anode shield 272 can be an annular elliptical cylinder or elliptical cylindrical shell, such a ring or washer. The anode shield 272 can be flat or beveled on at least one edge. In an example, a planar shield surface 216 (FIGS. 3A-3B) and the outside side surface of the anode shield 272 has a bevel. In an example, a thickness of the target material is greater than a thickness of the shield material. In another example, the thickness of the shield material is greater than 20 microns. In another example, the thickness of the shield material blocks over 99% of K radiation emitted from the substrate material beneath the anode shield 272.

Figure 3A:
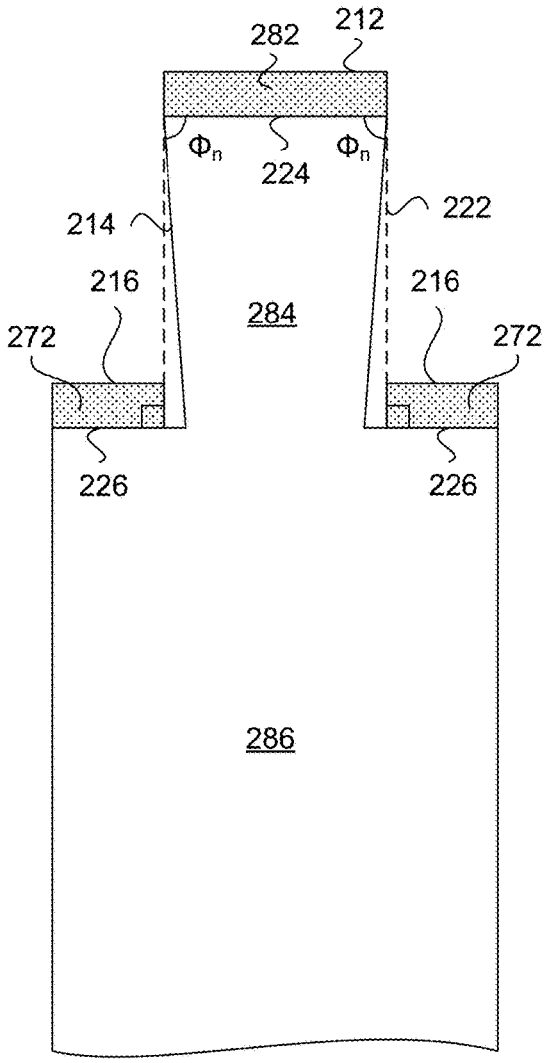
FIGS. 3A-3B illustrate section view of an anode with anode shield with a non-uniform first cross-sectional dimension.
Figure 3B:
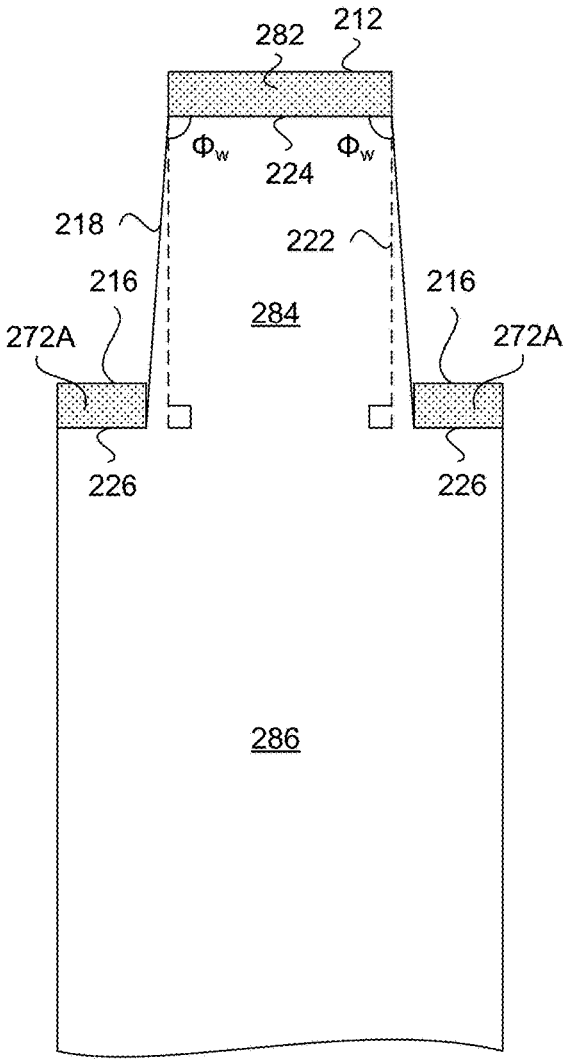

FIGS. 3A-3B illustrate section view of an anode with anode shield with a non-uniform first cross-sectional dimension. In an example, a planar target surface 212 of the target 282 is substantially parallel to a planar shield surface 216 of the anode shield 272. In an example, a planar first portion surface 224 of the first portion 284 of the substrate can be substantially orthogonal (i.e., within 1° of orthogonal or90°) 222 to a side surface 214 or 218 of the first portion 284. In another example, the planar first portion surface 224 of the first portion 284 of the substrate has an angle Φ between 88° and 92° (i.e., within 2° of orthogonal) with a side surface 214 or 218 of the first portion 284. In another example, the planar first portion surface 224 of the first portion 284 of the substrate has an angle Φ between 85° and 95° (i.e., within 5° of orthogonal) with a side surface 214 or 218 of the first portion 284. In another example, the planar first portion surface 224 of the first portion 284 of the substrate has an angle 1 between 80° and 90° (i.e., within 10° of orthogonal) with a side surface 214 or 218 of the first portion 284. When the angle Φn (phi narrow) of the side wall 214 of the first portion 284 becomes smaller than 90° , so the substrate becomes narrowest at the intersection 204 (illustrated in FIGS. 2A-2C) between the first portion 284 and the second portion 286, the thermal conduction of the anode is constricted which can increase the temperature at the target relative to a similar voltage and power applied to an anode with an orthogonal side wall 222 of the first portion 284, which can reduce the power rating and/or life of the x-ray tube. When the angle Φw (phi wide) of the side wall 218 of the first portion 284 becomes greater than 90° , so the substrate has a taper on the side wall 218 of the first portion 284 between the target 282 and the second portion 286, the thermal conduction of the anode improves, which can decrease the temperature at the target relative to a similar voltage and power applied to an anode with an orthogonal side wall 222 of the first portion 284, which can increase the power rating and/or life of the x-ray tube. But the angle Φw (phi wide) greater than 90° may increase the spectral contamination as more unblocked backscatter x-rays with substrate material characteristics is emitted from the tapered areas of the side wall 218 of the first portion 284. Experiments and simulation show that side walls with angle 1 greater than 90° (for vacuum enclosure opening 228 with an opening cross-sectional dimension similar to [e.g., within 20%] of the second cross-sectional dimension 296 of the second portion 286) will emit backscatter x-rays with substrate material characteristics having an emission angle that will pass through the x-ray transmissive window 232.

Figure 4A:
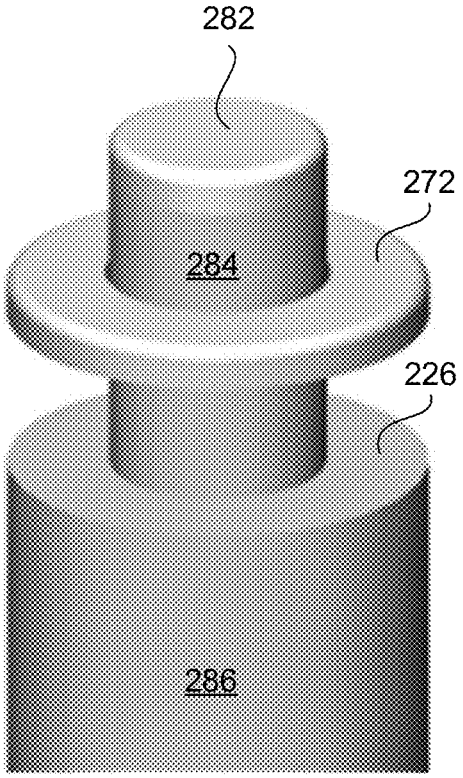
FIGS. 4A-4B illustrate perspectives view of an assembly of an anode shield.
Figure 4B:
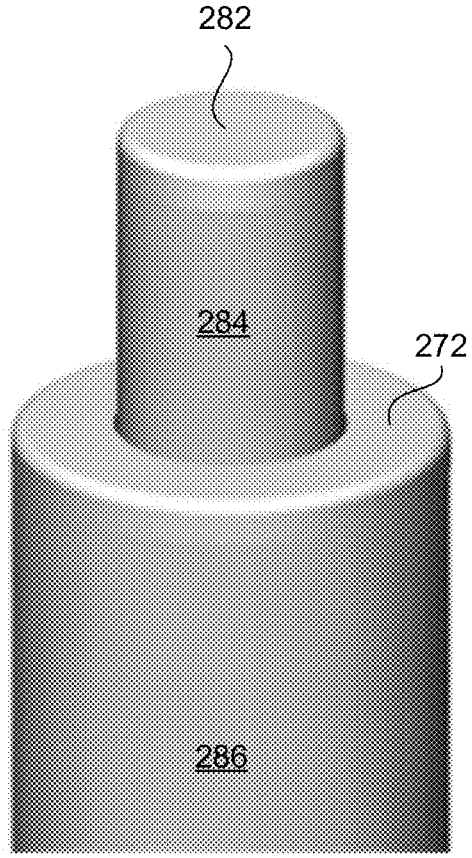
Figure 5:
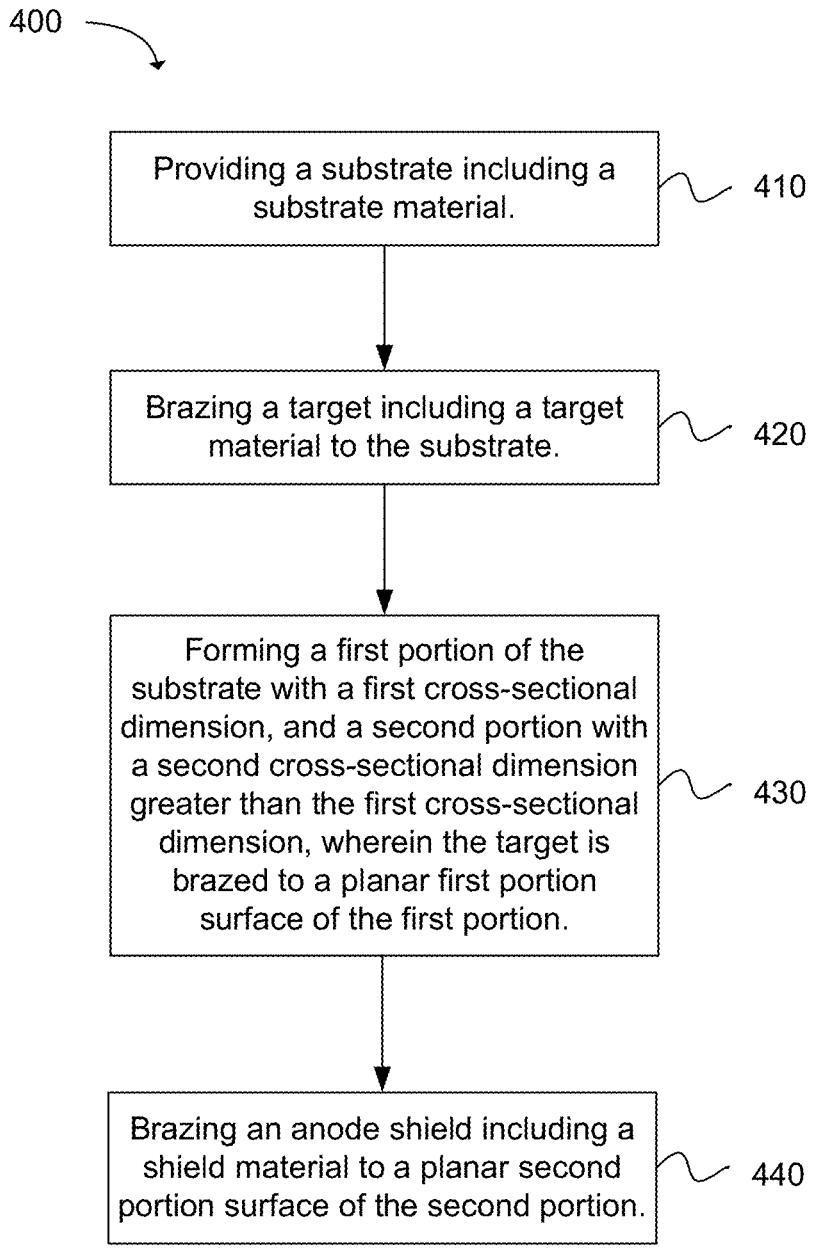
FIG. 5 is a flowchart illustrating an example of a method of manufacturing an anode with an anode shield.

FIGS. 4A-4B illustrate perspectives view of an assembly of an anode shield. FIG. 5 is a flowchart illustrating a method 400 of manufacturing an anode with an anode shield. The anode can be manufactured by a process including providing a substrate 274 including a substrate material, as in step 410, brazing a target 282 including a target material to the substrate 274, as in step 420, and forming a first portion 284 of the substrate 274 with a first cross-sectional area 294, and a second portion 286 with a second cross-sectional area 296 greater than the first cross-sectional area 294, and the target 282 is brazed to a planar first portion surface 224 of the first portion 284, as in step 430, and brazing an anode shield 272 including a shield material to a planar second portion surface 226 of the second portion 286, as in step 440. Forming the first portion 284 and the second portion 286 of the substrate 274 can include machining the first portion 284 to a smaller cross-sectional dimension than the second portion 286. Brazing the anode shield 272 can include adding a braze material to adhere the substrate 274 to the anode shield 272. Automation may be used to manufacture the anode. In some embodiments, the anode shield 272 may be brazed to the second portion 286 of the substrate 274 before brazing the target 282 to the first portion 284 of the substrate 274.

Analytical x-ray tubes may be used to generate x-ray fluorescence (XRF), which is the emission of characteristic "secondary" (or fluorescent) x-rays from a material that has been excited by being bombarded with high-energy x-rays or gamma rays. The XRF phenomenon is widely used for elemental analysis and chemical analysis. X-ray spectroscopy refers to several spectroscopic techniques for characterization of materials by using x-ray excitation. When an electron from the inner shell of an atom is excited by the energy of a photon, such as an x-ray, the electron moves to a higher energy level. When electron returns back to the low energy level, the energy which electron previously gained by the excitation is emitted as a photon which has a wavelength that is characteristic for the element, which can include several characteristic wavelengths per element. In x-ray spectroscopy, the alpha line is often the primary spectral line (from the various spectral lines that are characteristic to elements) of interest in many industrial applications. For example, K-alpha emission lines result when an electron transitions to the innermost "K" shell (principal quantum number 1) from a 2p orbital of the second or "L" shell (with principal quantum number 2). K-alpha emission is composed of two spectral lines, K-alpha$_1$ and K-alpha$_2$. The K-alpha$_1$ emission is higher in energy and thus has a lower wavelength than the K-alpha$_2$ emission. A larger number of electrons follow the K-alpha$_1$ transition ($L_3$3 →K) relative to the K-alpha$_2$ ($L_2$→K) transition which causes the K-alpha$_1$ emission to be more intense than K-alpha$_2$. K-beta emissions, similar to K-alpha emissions, result when an electron transitions to the innermost "K" shell (principal quantum number 1) from a 3p orbital of the third or "M" shell (with principal quantum number 3). The energy generated by the K-beta emissions is typically less than the K-alpha emissions. The Siegbahn notation and International Union of Pure and Applied Chemistry (IUPAC) notation are used in x-ray spectroscopy to name the spectral lines that are characteristic to elements.

Figure 6:
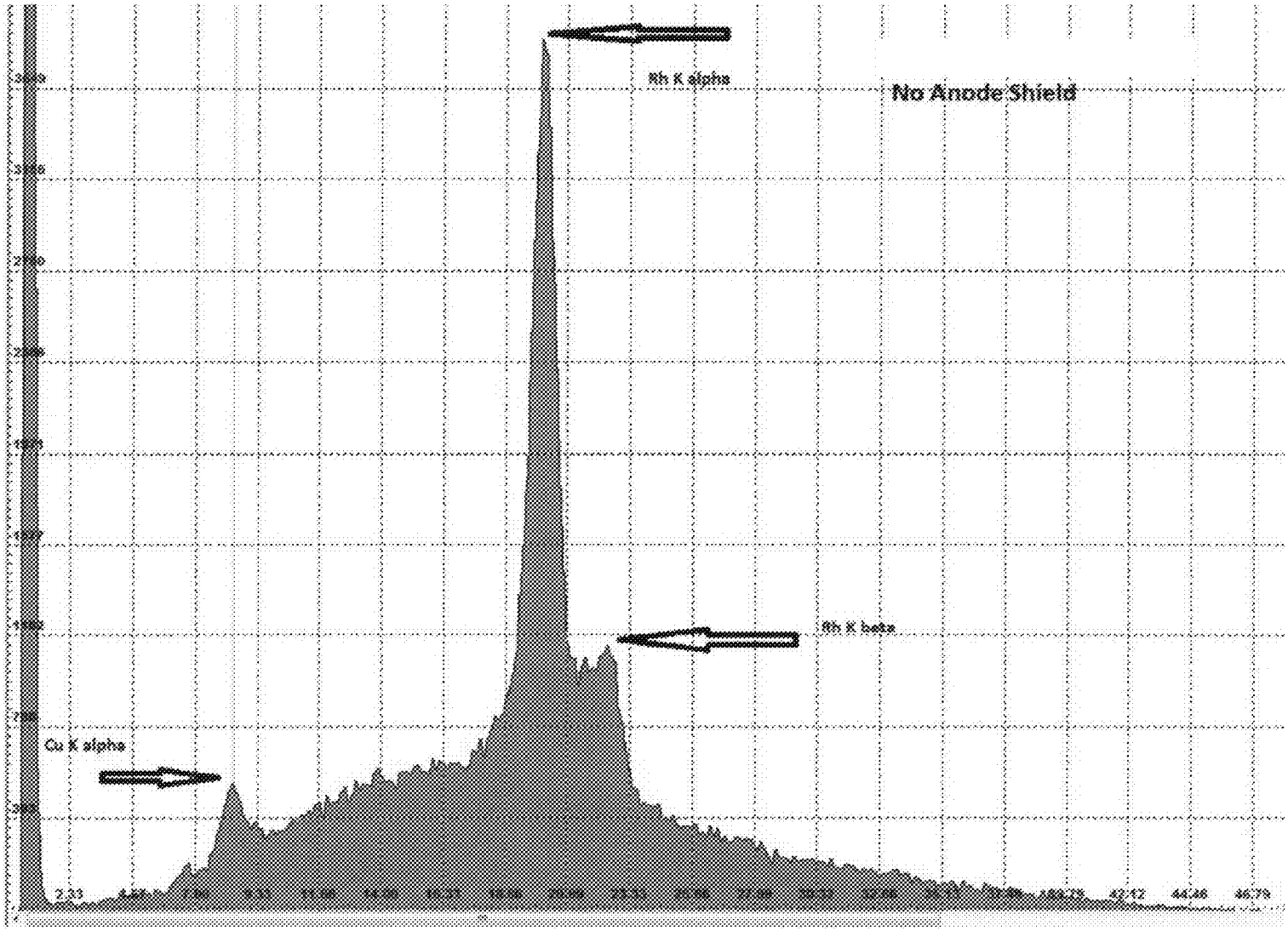
FIG. 6 illustrates spectral graph of x-ray energy levels generated from a tapered anode with a copper (Cu) substrate, a rhodium (Rh) target, and a rhodium coating.

FIG. 6 illustrates spectral graph of x-ray energy levels generated from a tapered anode with a copper (Cu) substrate, a rhodium (Rh) target, and a 1.5 micron rhodium coating on the first portion 84 (184) and the taper 88 (188) as illustrated in FIGS. 2A and 3 (FIG. 4) of the '092 Patent. Copper has an 8.05 kiloelectronvolt (keV) K-alpha$_1$ ($K\alpha_1$) using Siegbahn notation and an 8.05 keV K-$L_3$ using IUPAC notation, and an 8.90 keV K-beta$_1$ ($K\beta_1$) using Siegbahn notation and an 8.90 keV K-$M_3$ using IUPAC notation. Rhodium has a 20.21 keV K-alpha$_1$ ($K\alpha_1$) and a 22.72 keV K-beta$_1$ ($K\beta_1$). Along with the K-alpha$_1$ ($K\alpha_1$) and K-beta$_1$ ($K\beta_1$) spectral lines generated from the rhodium target, as shown, a K-alpha$_1$ ($K\alpha_1$) spectral line generated from the copper substrate is also being generated even with the thin 1.5 micron rhodium coating, which does not block or filter substantially all (i.e., greater than 99%) of the backscatter x-rays generated from copper substrate and exiting the x-ray transmissive window 232. The addition of the K-alpha$_1$ ($K\alpha_1$) spectral line contributed from the copper substrate generates spectral contamination (copper contamination or copper spectral contamination), which makes analysis of industrial materials with copper difficult and imprecise.

Figure 7:
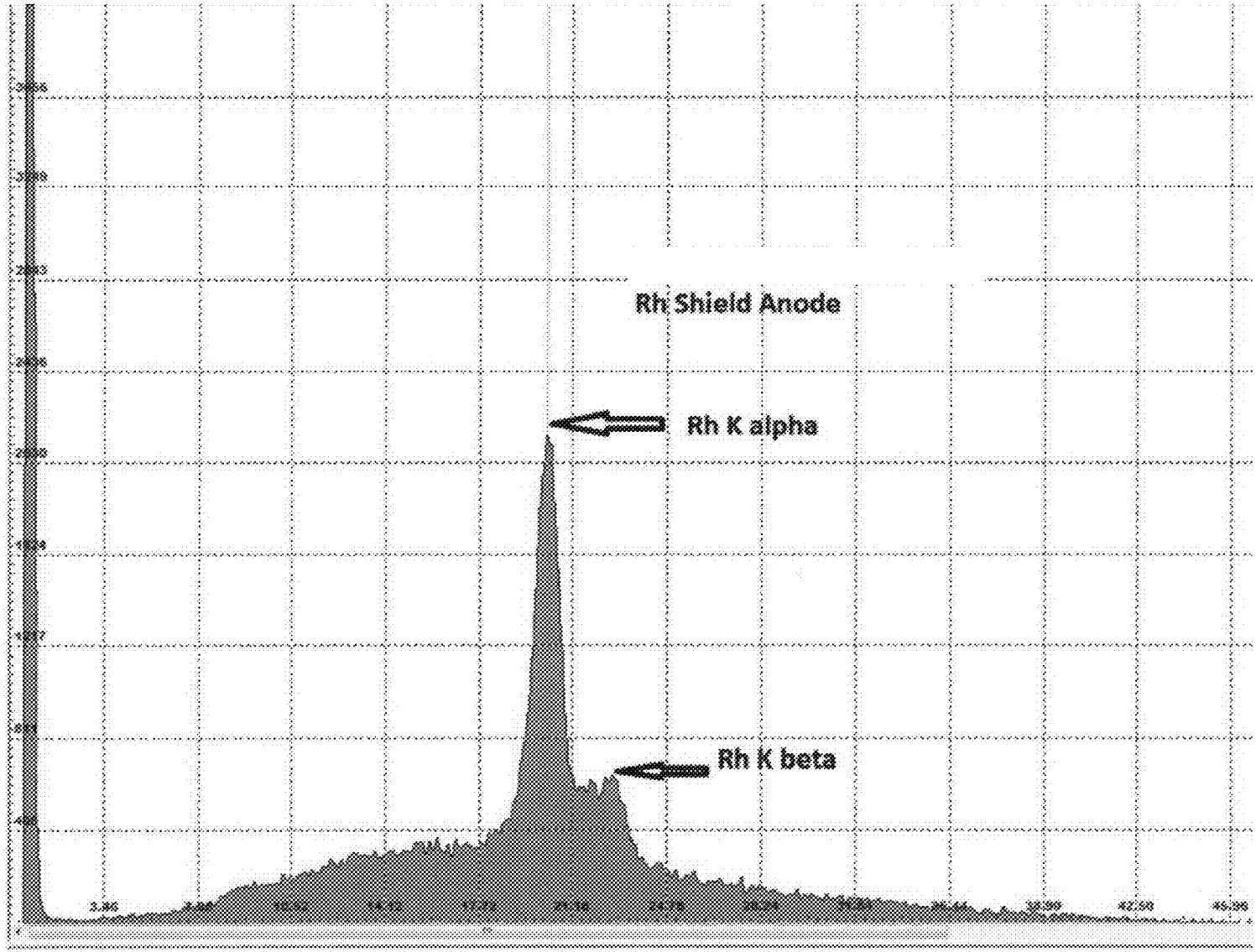
FIG. 7 illustrates spectral graph of x-ray energy levels generated from an anode with a copper substrate, a rhodium target, and a rhodium anode shield.

FIG. 7 illustrates spectral graph of x-ray energy levels generated from an anode with a copper substrate 274, a rhodium target 282, and a rhodium anode shield 272. As shown, the K-alpha$_1$ ($K\alpha_1$) and K-beta$_1$ ($K\beta_1$) spectral lines are generated from the rhodium target without any spectral lines or contamination or a substantially reduced amount contributed from the copper substrate. An anode shield 272 with a thickness of 50 microns can shield over 99.9% Cu K radiation from backscatter x-rays generated from copper substrate and exiting the x-ray transmissive window 232. Although 50 microns is used as an example of the thickness of the anode shield 272, in other embodiments, the thickness may be different as described above and still reduce the contribution from the copper substrate.

Figure 8A:
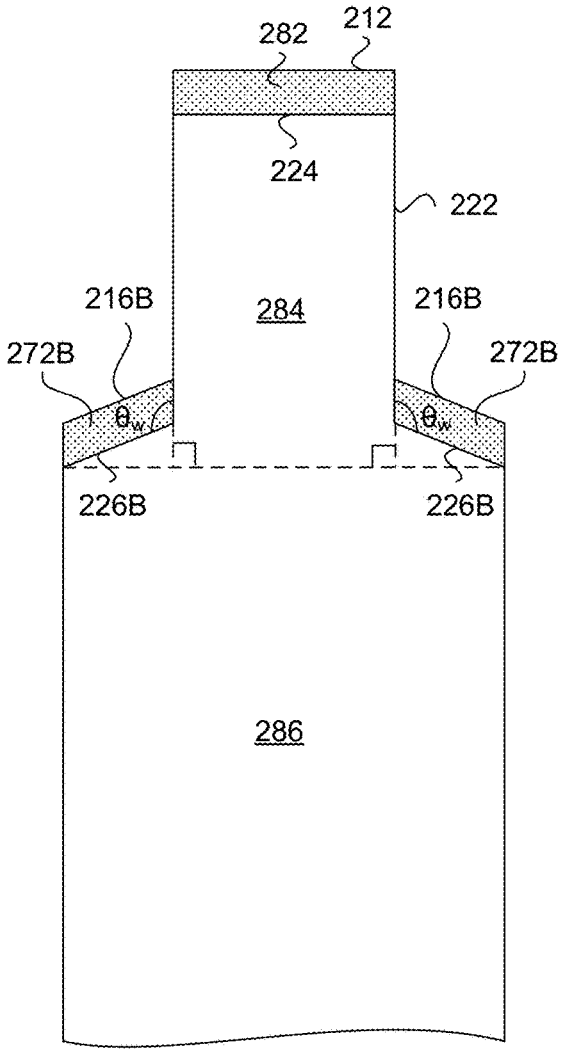
FIGS. 8A-8B illustrate section view of an anode with anode shield with non-orthogonal angles to side walls of an anode substrate.
Figure 8B:
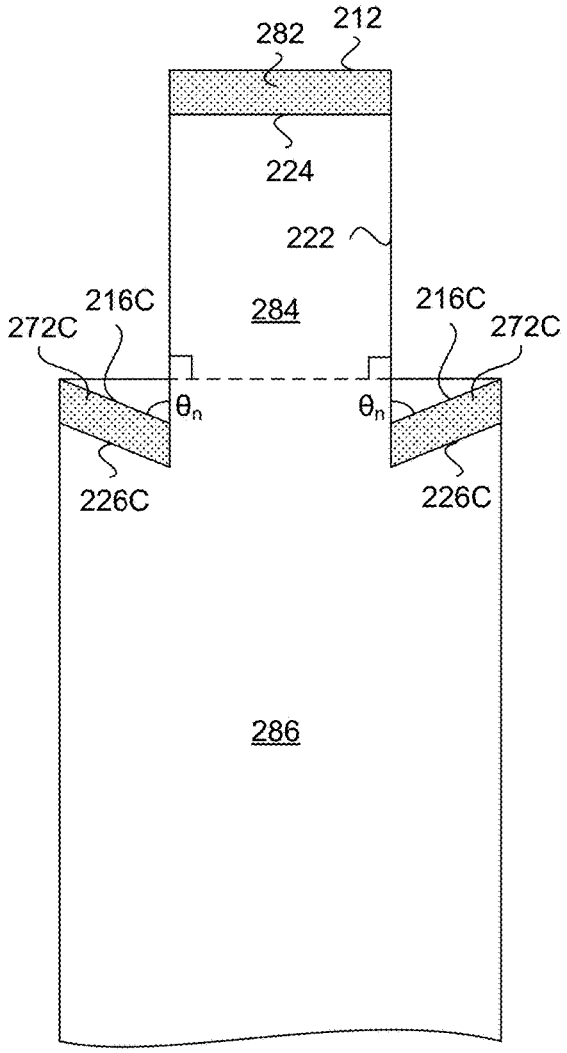

FIGS. 8A-8B illustrate section view of an anode with anode shield with a non-orthogonal angle θ to a side surface 222 of the first portion 284 of the substrate 274. Similar to FIGS. 3A-3B, the planar target surface 212 of the target 282 is substantially parallel to the planar shield surface 216 of the anode shield 272. In FIG. 8A, the area or volume of the substrate 274 between the first portion 284 and second portion 286 can have an elliptical or circular conical frustum shape with a taper 226B from the first portion 284 to the second portion 286. The angle θw (theta wide) of the taper 226B from the side surface 222 of the first portion 284 is greater than 90° . In an example, the angle θw is between 90° and 95° (i.e., within 5° of orthogonal). In another example, the angle θw is between 91° and 100° (i.e., within 10° of orthogonal). In another example, the angle θw is between 95° and 120° (i.e., within 30° of orthogonal). In another example, the angle θw is between 95° and 135° (i.e., within 45° of orthogonal). The anode shield 272B has a corresponding shape to the taper 226B. In an example, the anode shield 272B is a hollow elliptical conical frustum. In an example, an outward facing surface 216B is substantially parallel with an inward facing surface 226B.

In FIG. 8B, the area or volume of the substrate 274 between the first portion 284 and second portion 286 can include an elliptical or circular spherical cap shape, a bowl shape, or in inverted elliptical or circular conical frustum shape with a slope 226C from the first portion 284 to the second portion 286. The angle θw (theta narrow) of the slope 226C from the side surface 222 of the first portion 284 is less than 90° . In an example, the angle θw is between 85° and 90° (i.e., within 5° of orthogonal). In another example, the angle θw is between 80° and 89° (i.e., within 10° of orthogonal). In another example, the angle θw is between 60° and 85° (i.e., within 30° of orthogonal). In another example, the angle θw is between 45° and 85° (i.e., within 45° of orthogonal). The anode shield 272C has a corresponding shape to the slope 226C. In an example, the anode shield 272C is a hollow elliptical conical frustum. In an example, an outward facing surface 216C is substantially parallel with an inward facing surface 226C.

FIGS. 8A-8B illustrate a uniform first cross-sectional dimension 294 of the first portion 284 of the anode. In other examples, the anode substrate and anode shields 272B, 272C illustrated in FIGS. 8A-8B can be combined with the non-uniform first cross-sectional dimension 294 described in FIGS. 3A-3B.

FIGS. 1-4B and 8A-8B illustrate anode shields 272, 272A, 272B, 272C with a uniform thickness and a relatively smooth outer surface 216, 216B, 216C. In some examples, the thickness can be non-uniform, such as thinner on the outer edges and thicker on the inner edge (not shown), or thicker on the outer edges and thinner on the inner edge (not shown), or some other non-uniform thickness or pattern on the outer surface 216, 216B, 216C. In some examples, the outer surface 216, 216B, 216C of the anode shields 272, 272A, 272B, 272C can have a surface texture or surface finish with various characteristics of lay, surface roughness, and waviness.

Some embodiments include an anode, comprising: a substrate 274 including a substrate material, comprising: a first portion 284 with a first cross-sectional dimension 294, and a second portion 286 with a second cross-sectional dimension 296 greater than the first cross-sectional dimension 294; a target 282 including a target material attached to a first surface 224 of the first portion 284 of the substrate; and an anode shield 272 including a shield material attached to a second surface of the second portion 286 of the substrate, where the substrate material differs from the target material and the shield material.

In some embodiments, the target 282 is brazed to the first portion 284 of the substrate 274, and the anode shield 272 is brazed to the second portion 286 of the substrate 274. In some embodiments, the anode further comprises a braze material between the anode shield 272 and a planar second portion surface 226 of the second portion 286.

In some embodiments, the anode shield 272 is an annular elliptical cylinder, an elliptical cylindrical shell, or a hollow elliptical conical frustum. In some embodiments, a planar target surface 212 of the target 282 is substantially parallel to a planar shield surface 216 of the anode shield 272. In some embodiments, the first portion 284 and a second portion 286 of the substrate form elliptic cylinders with substantially parallel surfaces. In some embodiments, a planar first portion surface 224 of the first portion 284 of the substrate is substantially orthogonal to a side surface 214 of the first portion 284.

In some embodiments, a planar first portion surface 224 of the first portion 284 of the substrate has an angle Φ between 85° and 95° with a side surface 214 of the first portion 284. In some embodiments, a planar first portion surface 224 of the first portion 284 of the substrate has an angle $\Phi_n$ less than 90° with a side surface 214 of the first portion 284.

In some embodiments, a thickness of the target material is greater than a thickness of the shield material. In some embodiments, a thickness of the shield material is greater than 20 microns (μm). In some embodiments, a thickness of the shield material blocks over 99% of K radiation emitted from the substrate material beneath the anode shield 272.

In some embodiments, the substrate material comprises copper (Cu), silver (Ag), pyrolytic carbon or pyrolytic graphite, or combinations thereof. In some embodiments, the target material and the shield material each comprises scandium (Sc), titanium (Ti), cobalt (Co), molybdenum (Mo), rhodium (Rh), palladium (Pd), tungsten (W), platinum (Pt), niobium carbide (NbC or $Nb_2C$), tantalum carbide ($TaC_x$), or combinations thereof. In some embodiments, the target material and the shield material comprise substantially the same material. In some embodiments, the target material and the shield material have a K-alpha$_1$ ($K\alpha_1$) energy level 1.5 times greater than the K-alpha$_1$ energy level of the substrate material. In some embodiments, a planar shield surface 216 and an outside side surface of the anode shield 272 has a bevel.

Some embodiments include an x-ray tube comprising: a vacuum enclosure 234 including an x-ray transmissive window 232 covering an opening 228 in the vacuum enclosure; a cathode assembly 236 disposed within the vacuum enclosure, the cathode assembly including an electron source 262 configured to emit electrons; and an anode previously described disposed within the vacuum enclosure, the anode configured to generated x-rays from electrons striking the target 282.

In some embodiments, the cathode assembly 236 further comprises focusing electrode including a substantially geometrically continuous surface 220 facing the first portion 284 and the second portion 286 of the substrate. In some embodiments, the opening 228 in the vacuum enclosure has opening cross-sectional dimension within 20% of the second cross-sectional dimension of the second portion 286.

Some embodiments use a method of manufacturing an anode, where the method comprises: providing a substrate including a substrate material; brazing a target 282 including a target material to the substrate; and forming a first portion 284 of the substrate 274 with a first cross-sectional area, and a second portion 286 with a second cross-sectional area greater than the first cross-sectional area, wherein the target is brazed to a planar first portion surface 224 of the first portion 286; and brazing an anode shield 272 including a shield material to a planar second portion surface 226 of the second portion 286.

In some embodiments, forming the first portion 284 and the second portion 286 of the substrate 274 includes machining the first portion 284 to a smaller cross-sectional dimension than the second portion 286. In some embodiments, brazing the anode shield includes adding a braze material to adhere the substrate 274 to the anode shield 272. In some embodiments, at least one non-transitory machine-readable storage medium comprising a plurality of instructions are adapted to be executed to implement the method above.

Some embodiments include an anode, comprising: a target means including a target material for generating x-rays when electrons strike the target; a substrate means including a substrate material for supporting the target and conducting heat away from the target, wherein substrate means has a first cross-sectional dimension smaller than a second cross-sectional dimension; an anode shielding means including a shield material for blocking backscatter x-rays generated from the second cross-sectional dimension non-overlapping with first cross-sectional dimension of the substrate means. The substrate material differs from the target material and the shield material. Examples of target means include the target 282. Examples of substrate means include the substrate 274, the first portion 284, the second portion 286, the tapered portion 290, and the third portion 292. In an example, the second cross-sectional dimension 296 non-overlapping with first cross-sectional dimension 294 refers to the area of the second portion 286 not covered by the first portion 284. Examples of anode shielding means include the anode shield 272, 272A, 272B, 272C.

In some examples, the substrate material of substrate means has a melting point greater than 900° C. In some examples, the substrate material of substrate means has a thermal conductivity greater than 300 W/(m·K). In some examples, the target material and the shield material have a K-alpha$_1$ ($K\alpha_1$) energy level 50% greater than the K-alpha$_1$ energy level of the substrate material. In some examples, a thickness of the shield material blocks over 99% of K radiation emitted from the substrate material of the anode shielding means.

The summary provided above is illustrative and is not intended to be in any way limiting. In addition to the examples described above, further aspects, features, and advantages of the invention will be made apparent by reference to the drawings, the following detailed description, and the appended claims.

Reference throughout this specification to an "example" or an "embodiment" means that a particular feature, structure, or characteristic described in connection with the example is included in at least one embodiment of the invention. Thus, appearances of the words an "example" or an "embodiment" in various places throughout this specification are not necessarily all referring to the same embodiment.

Furthermore, the described features, structures, or characteristics may be combined in a suitable manner in one or more embodiments. In the following description, numerous specific details are provided (e.g., examples of layouts and designs) to provide a thorough understanding of embodiments of the invention. One skilled in the relevant art will recognize, however, that the invention can be practiced without one or more of the specific details, or with other methods, components, layouts, etc. In other instances, well-known structures, components, or operations are not shown or described in detail to avoid obscuring aspects of the invention.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the claims beginning with claim [x] and ending with the claim that immediately precedes this one," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claim 1, 2, or 3, with these separate dependencies yielding three distinct embodiments; claim 5 can depend from any one of claim 1, 2, 3, or 4, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed to cover the corresponding structure, material, or acts described herein and equivalents thereof in accordance with 35 U.S.C. § 112(f). Embodiments of the invention in which an exclusive property or privilege is claimed are defined as follows.

What is claimed is:

1. An anode, comprising:

a substrate including a substrate material, comprising:

a first portion with a first cross-sectional dimension, a first surface, and a side surface, and a second portion with a second cross-sectional dimension greater than the first cross-sectional dimension and a second surface, wherein the side surface extends between the first surface and the second surface;

a target including a target material attached to the first surface of the first portion of the substrate; and an anode shield including a shield material attached to the second surface of the second portion of the substrate, wherein;

the substrate material differs from the target material and the shield material; and the anode shield covers less than all of the side surface.

2. The anode of claim 1, wherein the target is brazed to the first portion of the substrate, and the anode shield is brazed to the second portion of the substrate.

3. The anode of claim 1, wherein the anode shield is an annular elliptical cylinder, an elliptical cylindrical shell, or a hollow elliptical conical frustum.

4. The anode of claim 1, wherein the first portion and the second portion of the substrate form elliptic cylinders with substantially parallel surfaces.

5. The anode of claim 1, wherein:

a planar target surface of the target is substantially parallel to a planar shield surface of the anode shield; or the first surface of the first portion of the substrate is a planar first portion surface that is substantially orthogonal to the side surface of the first portion.

6. The anode of claim 1, wherein the first surface of the first portion of the substrate has:

an angle ($\Phi$) between 85° and 95° with the side surface of the first portion; or an angle ($\Phi_n$) less than 90° with the side surface of the first portion.

7. The anode of claim 1, wherein a thickness of the target material is:

greater than a thickness of the shield material; or greater than 20 microns.

8. The anode of claim 1, wherein:

the substrate material comprises copper (Cu), silver (Ag), pyrolytic carbon or pyrolytic graphite, or combinations thereof; and the target material and the shield material each comprises scandium (Sc), titanium (Ti), cobalt (Co), molybdenum (Mo), rhodium (Rh), palladium (Pd), tungsten (W), platinum (Pt), niobium carbide (NbC or $Nb_2C$), tantalum carbide ($TaC_x$), or combinations thereof.

9. The anode of claim 1, wherein the target material and the shield material comprise substantially the same material.

10. The anode of claim 1, wherein the target material and the shield material have a K-alpha$_1$ ($K\alpha_1$) energy level 1.5 times greater than the K-alpha$_1$ energy level of the substrate material.

11. An x-ray tube, comprising:

a vacuum enclosure including an x-ray transmissive window covering an opening in the vacuum enclosure;

a cathode assembly disposed within the vacuum enclosure, the cathode assembly including an electron source configured to emit electrons; and the anode of claim 1 disposed within the vacuum enclosure, the anode configured to generate x-rays from electrons striking the target.

12. The x-ray tube of claim 11, wherein the cathode assembly further comprises a focusing electrode including a substantially geometrically continuous surface facing the first portion and the second portion of the substrate.

13. The x-ray tube of claim 11, wherein the opening in the vacuum enclosure has an opening cross-sectional dimension within 20% of the second cross-sectional dimension of the second portion.

14. A method of manufacturing an anode, the method comprising:

providing a substrate including a substrate material;

forming a first portion of the substrate with a first cross-sectional area, a first surface, and a side surface;

forming a second portion of the substrate with a second cross-sectional area greater than the first cross-sectional area and a second surface, wherein the side surface extends between the first surface and the second surface;

brazing a target including a target material to the first surface of the first portion of the substrate; and brazing an anode shield including a shield material to a the second surface of the second portion such that the anode shield covers less than all of the side surface.

15. The method of claim 14, wherein forming the first portion and the second portion of the substrate includes machining the first portion to a smaller cross-sectional dimension than the second portion.

16. The method of claim 14, wherein brazing the anode shield includes adding a braze material to adhere the substrate to the anode shield.

17. An anode, comprising:

a target means including a target material for generating x-rays when electrons strike the target means;

a substrate means including a substrate material for supporting the target means and conducting heat away from the target means, wherein the substrate means has a first cross-sectional dimension smaller than a second cross-sectional dimension; and an anode shielding means including a shield material for blocking backscatter x-rays generated from the second cross-sectional dimension non-overlapping with the first cross-sectional dimension of the substrate means without blocking backscatter x-rays generated from a portion of the substrate means between the target means and the anode shielding means, wherein the substrate material differs from the target material and the shield material.

18. The anode of claim 17, wherein the substrate material of the substrate means has a melting point greater than 900° C. or a thermal conductivity greater than 300 W/(m·K).

19. The anode of claim 17, wherein the target material and the shield material have a K-alpha$_1$ ($K\alpha_1$) energy level 50% greater than the K-alpha$_1$ energy level of the substrate material.

20. The anode of claim 17, wherein a thickness of the shield material blocks over 99% of K radiation emitted from the substrate material of the anode shielding means.

* * * * *